United States Patent [19]

Tkachev et al.

[11] 4,209,057

[45] Jun. 24, 1980

[54] METHOD FOR INDUCTION HARD-FACING

[76] Inventors: Valentin N. Tkachev, ulitsa Sadovo-Spasskaya, 21, kv.102, Moscow; Boris M. Fishtein, prospekt Voroshilovsky, 89/80, kv. 49, Rostov-na-Donu; Viktor D. Vlasenko, ulitsa Semashko, 50, kv. 48, Rostov-na-Donu; Nikolai V. Kazintsev, 14 linia, 35a, Rostov-na-Donu, all of U.S.S.R.

[21] Appl. No.: 870,501

[22] Filed: Jan. 18, 1978

[51] Int. Cl.[2] ..... B22D 19/08

[52] U.S. Cl. ..... 164/51; 164/98; 75/208 R

[58] Field of Search ..... 164/59, 75, 76, 97, 164/98, 99, 50, 51; 75/208 R; 148/2, 3

[56] References Cited

U.S. PATENT DOCUMENTS 781,816 2/1905 Esteve-Llatas ..... 164/75

2,411,862 12/1946 Arnold ..... 164/98

3,407,478 10/1968 Arnoldy ..... 29/527.2

FOREIGN PATENT DOCUMENTS 522900 8/1976 U.S.S.R. ..... 164/97

*Primary Examiner*—Robert D. Baldwin

*Assistant Examiner*—K. Y. Lin

*Attorney, Agent, or Firm*—Fleit & Jacobson

[57] ABSTRACT

A method for induction hard-facing, wherein a powder charge is applied to the surface of an item; the item with the powder charge thereon is heated in the electromagnetic field of an inductor until melted to form a hard alloy and a slag, said molten hard alloy being acted upon through the slag layer by a tool carrying on its surface peaks and valleys to form an item with peaks built of hard structural components and of valleys containing plastic components of the melt; the item is then cooled and the action of the tool continued until the hard alloy solidifies completely.

2 Claims, 1 Drawing Figure

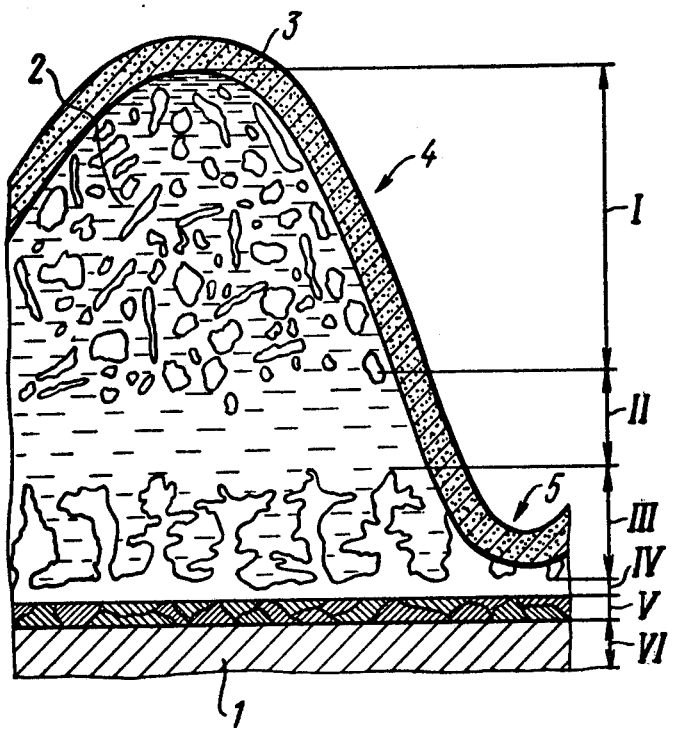
3
2
4
I
II
5
III
IV
V
VI
1

METHOD FOR INDUCTION HARD-FACING

The invention concerns welding, in particular, methods for induction hard-facing.

The invention may be used in the practice of hard-facing surfaces of parts exposed to abrasive wear in service.

In modern welding, hard-facing is a technique widely used to enhance the resistance and the durability of parts, induction heating being a frequently employed means.

Parts exposed to abrasive wear are hard faced with alloys of extra hardness, this ensuring a greater wear resistance thereof. However, along with adequate hardness, said alloys are rather brittle, and ultimate strength thereof in static bending, being a function of alloy hardness, is $\sigma=22$ to 32 kg/mm$^2$ which makes impossible the use of said alloys for hard-facing parts subject to bending and thus restricts the field of their hard-facing applications.

There is a wide range of curvilinear parts whose curved surfaces are exposed to severe abrasive wear in service and require hard-facing.

When a part hard faced on the external generatrix of the curved surface is bent, the hard alloy tends to form cracks which extend into the base metal thereby lowering the strength and the durability of the hard-faced part even in comparison with a non-hard-faced part and making the hard-faced part practically unfit for service.

Therefore, the problem is to provide such a hard-facing method which will enhance the wear resistance and the durability with no adverse effect upon the plastic properties of items.

There is known a method for manufacturing wear-resistant blades of working tools of tillage machines, wherein, with a view to corrugate the blades and so make them self-sharpening, a harder metal is disposed on the smooth surface of the blades intermittently and parallelly to the cutting edge.

A disadvantage of the method is that the non-hard-faced sections of the surface show a low abrasive resistance and thus lower the overall wear resistance and the durability of items.

There is also known a method for manufacturing wear-resistant sheets by applying a hard and brittle material upon a relatively plastic and weldable base metal and subsequently forming, by mechanical action with the aid of a punch and a die, cracks in the hard material spaced 75 mm apart. It then becomes possible to bend such sheets at radii of up to 20 sheet gauge values. The cracks do not extend into the base metal. The sheets may be rolled, forged, welded and otherwise worked. For example, a carbon steel is brazed or hard-faced with an alloy consisting of (% by mass): Cr, 27; C, 3.5; Fe, the balance, in a layer 3 mm thick, then cracks are formed at distances of 15 to 19 mm apart.

A disadvantage of the method is that the formation of cracks by mechanical means in the hard material affects adversely the monolithic properties thereof, causes the brittle metal to spall and thereby lowers the wear resistance and the strength of the item.

There is known a method for induction hard-facing, wherein a powder charge is placed on the surface of an item to be reinforced, then heated in the electromagnetic field of an inductor until melted to a hard alloy and a slag, the item then being cooled until the layer of the hard alloy solidifies completely.

The hard-faced surface is a hard alloy monolith uniformly distributed throughout the surface to be reinforced and featuring a zonal structure across the hard-faced layer.

A typical microstructure of a part surfaced by an alloy, e.g., of the following chemical composition (% by mass): C, 2.5 to 3.5; Si, 2.8 to 4.2; Mn, 0.5 to 1.5; Cr, 25 to 31; Ni, 3.0 to 5.0; Fe, the balance, consists of six different structural zones:

I—a hypereutectic zone composed substantially of excess carbides and a carbide eutectic with areas of structurally-free austenite of a HRC hardness number of 56 to 57;

II—an eutectic zone which is a ledeburite-type carbide eutectic of a HRC hardness number of 50 to 53;

III—a hypoeutectic zone characteristic of which are solid solution dendrites and a carbide eutectic of a HRC hardness number of 46;

IV—a boundary zone composed of an alloyed austenite of a VHN hardness number of 530 to 720 kgf/mm$^2$;

V—a diffusion zone which is an edging of thin lamellar pearlite of a VHN hardness number of 230 to 330 kgf/mm$^2$;

VI—a base metal.

The ratio of the wear resistance of the hard alloy structural zones, viz., hypereutectic, eutectic and hypoeutectic ones, is 1:0.67:0.57.

A disadvantage of the method is that it comprises no means, for a same chemical composition of the power charge for controlling the distribution of the hard alloy structural zones and the wear-resistance throughout the length of the hard faced part.

The invention has as its aim the provision of such an induction hard-facing method which will increase the wear-resistance of the hard alloy and the durability of the item and will make possible the hard-facing of parts subject to bending, i.e., will greatly expand the field of application of induction hard-facing through a streamlining of the hard-facing procedure.

This aim is accomplished by the provision of a method for hard-facing the surface of an item by placing thereupon a powder charge, heating the item with the powder charge in the electromagnetic field of an inductor until the powder charge melts to produce a hard alloy and a slag, the item then being cooled until the hard alloy solidifies, in accordance with the invention, the molten hard alloy is acted upon through the slag layer by a tool, the surface thereof facing the melt carrying peaks and valleys, to form on the item peaks comprising hard alloy structural constituents and valleys comprising plastic constituents, the action of the tool being continued until the hard alloy solidifies completely.

It is good practice to act upon the molten hard alloy at temperatures ranging from 1100° to 1450° C.

The preferable forming of the hard structural constituents into peaks increases the extent of the hypereutectic zone (e.g. 1.9 to 2.2 mm as compared to 0.85 to 0.95 mm for the known hard-facing method). The relative value of the wear-resistant hypereutectic zone in the peaks increases parallelly (e.g., from 60% to 71%). At the same time, since the wear-resistant hypereutectic zone is quantitatively larger than the hypoeutectic zone, the wear resistance the layer offers is mainly due to that of the hypereutectic zone, the effect being a greater wear-resistance of the item as a whole.

Provision on the hard-faced item of peaks comprising hard structural constituents alternating with valleys comprising plastic constituents makes it possible to bend hard faced items with no adverse effect upon the mechanical strength and the durability of the item, this expanding the field of application of the induction hard-facing of curvilinear surface parts.

The method according to the invention for induction hard-facing makes it possible to control the ratio of the structural zones of the deposited hard alloy both lengthwise and vertically, in accordance with the requirements upon the item, by means of the tool design adjustments, this expanding the field of application of the induction hard-facing.

Embodiments of the invention will now be described by way of examples, with reference to the accompanying drawing.

Consider now the practical realization of the proposed method for induction hard-facing.

Applied to the surface of a part 1 (see the drawing) to be hard-faced is a powder charge of a hard alloy, e.g., sormite and a flux. The part with the charge thereon is placed inside an inductor and heated with the aid of an electromagnetic field until the powder charge is converted into a melt composed of a hard alloy 2 and a slag 3. Next, a tool with peaks and valleys arranged at specified intervals on the surface thereof facing the melt is used to act upon the hard alloy 2 through the layer of the slag 3 to form the melt into the peaks 4 comprising hard structural constituents and the valleys 5 comprising plastic structural constituents. The action by the tool is continued until the hard alloy solidifies completely. The action of the tool is effected at a melt temperature ranging from 1100° to 1450° C.

EXAMPLE 1

Parts from sheet steel containing (% by mass): C, 0.6 to 0.7; Mn, 0.9 to 1.2; Si, 0.17 to 0.37; Fe, the balance, and measuring 25×100×4 mm were induction hard faced. Hard-facing was effected over the whole surface area of the part with sormite of a following chemical composition (% by mass): C, 2.5 to 3.5; Si, 2.8 to 4.2; Mn, 0.5 to 1.5; Cr, 25 to 31; Ni, 3.0 to 5.0; Fe, the balance. The thickness of the hard faced layer was 1.5 mm. The flux used was a boron-bearing compound. The spacing of the peaks and of the valleys, a function of the tool used, was 5 and 10 mm. Profiling was performed with both a uniform distribution of the alloy in peaks and valleys and a lesser depth of valleys.

A part with the powder charge on its was heated in the electromagnetic field of an inductor until melted into a melt composed of a hard alloy and a slag. When the charge melted, the molten hard alloy was shaped over a range of temperatures from 1280° to 1350° C. through the slag layer by a tool of a specified peak-to-valley ratio on its surface facing the melt. Shaping was continued until the hard alloy solidified completely.

After the part was cooled and the slag removed from the surface thereof, polished sections and specimens of the part were prepared for respectively metallographic investigations and wear-resistance tests. To check parts for cracks in the hard-faced layer directly after hard facing and after reheating, some of the specimens were bent to a curve 30 mm in diameter at a temperature from 940° to 1000° C. Bending was effected by locating the alloy on the external generatrix of the curved surface.

The results of the induction hard-facing method tests are reported in Table 1.

Table 1

| Item No. 1 | Name of parameters 2 | Hard-facing: by melting a continuous layer of a charge and cooling until complete solidificaction without forming of the melt (prior art) 3 | Hard-facing: according to the proposed method, peaks 4 | Hard-facing: according to the proposed method, valleys 5 |
|---|---|---|---|---|
| 1. | Thickness of melt layer, mm | 1.4 to 1.6 | 2.7 to 3.0 | 0.01 to 0.15 |
| 2. | Absolute values and zone ratio percentage: | | | |
| | hypereutectic | 0.85 to 0.95 mm, 60% | 1.9 to 2.2 mm, 71% | — |
| | eutectic | 0.15 to 0.17 mm, 10% | 0.25 to 0.28 mm, 8% | — |
| | hypoeutectic | 0.4 to 0.5 mm, 30% | 0.6 to 0.71 mm, 21% | 0.01 to 0.15 |
| 3. | Layer thickness, mm | 1.51 | 2.7 | 0.05 |
| 4. | Wear on wear testing machine: | | | |
| | absolute, mm | 1.38 | 1.12 | |
| | wear of layer, % | $\frac{1.38}{1.51} \cdot 100 = 92$ | $\frac{1.12}{2.7} \cdot 100 = 41$ | |
| 5. | Relative wear resistance | 1 | $\frac{1.38}{1.12} = 1.23$ | |
| 6. | Relative durability of layer | 1 | $\frac{92}{41} = 2.4$ | |
| 7. | Wear on test bench in terms of layer thickness: | | | |
| | absolute, mm | 1.45 | 1.77 | 0.035 |
| | wear of layer, % | $\frac{1.45}{1.51} \cdot 100 = 96$ | $\frac{1.77}{2.7} \cdot 100 = 65.5$ | 70 |
| 8. | Relative wear resistance of surface | 1 | $\frac{1.45}{1.77} = 0.82$ | |
| 9. | Relative durability of surface | 1 | $\frac{96}{65.5} = 1.46$ | |
| 10. | Presence of cracks in bending to R = 15 mm for a peak and valley pitch of: | | | |
| | 10 mm | cracks* | cracks** | no cracks |

Table 1-continued

| Item No. 1 | Name of parameters 2 | Hard-facing: by melting a continuous layer of a charge and cooling until complete solidificaction without forming of the melt (prior art) 3 | according to the proposed method: peaks 4 | according to the proposed method: valleys 5 |
|---|---|---|---|---|
| | 5 mm | cracks* | no cracks | no cracks |

*Sum total width of cracks along the external surface of the alloy is equal to its elongation in bending.
**Cracks are present at peak tips extending to the base metal of a total width equal to 30 to 40% of the external perimeter elongation.

EXAMPLE 2

Hard-facing was performed on parts manufactured from sheet steel of the following chemical composition (% by mass): C, 0.6 to 0.7; Mn, 0.9 to 1.2; Si, 0.17 to 0.37; Fe, the balance, the parts measuring 25×100×4 mm. Parts were hard-faced throughout their surfaces by a powder composite alloy composed of 60% of sormite, the chemical composition (% by mass) being: C, 2.5 to 3.5; Si, 2.8 to 4.2; Mn, 0.5 to 1.5; Cr, 25 to 31; Ni, 3.0 to 5.0; Fe, the balance, and of 40% of tungsten carbide. The thickness of the hard-faced layer was 1.5 mm. The flux used was a boron-bearing compound. The spacing of the peaks and of the valleys was that of the tool used and was equal in pitch to 5 and 10 mm. Surface profiling was performed with both a uniform distribution of the alloy in peaks and valleys in terms of volumes and a lesser volume of valleys.

A part carrying a powder charge was heated in the electromagnetic field of an inductor until a melt of a hard alloy and a slag was formed. Upon the completion of melting, the melt was deformed at a temperature ranging from 1280° to 1350° C. through a slag layer covering the melt by a tool of a specified ratio of peaks and valleys on its surface facing the melt. The deformation was continued until the hard alloy solidified completely.

After the parts were cooled and slag removed from their surface, polished sections and special specimens were prepared from the parts for respectively metallographic investigations and wear resistance testing. A proportion of the parts were bent to a curve 30 mm in diameter at a temperature of from 940° to 1000° C. directly after hard-facing and reheating with a view to check them for cracks. Bending was performed with the alloy located on the external generatrix of the curved surface.

The microstructure of the composite alloy, composed of 60% of sormite and 40% of tungsten carbides, contains two structural zones. One is a zone of incomplete solution occupying 60 to 65% of the volume of the hard alloy in depth. This zone consists of acute-angled unmelted particles of the high-melting component (tungsten carbides), of dendrites of the hard solid solution and of a carbide eutectic which is a binder.

The other zone is that of a complete solution occupying 35 to 40% of the volume of the built-up alloy and located above the zone of incomplete solution. This zone is composed mainly of excess carbides, and a carbide eutectic with areas of structurally-free austenite.

The results of the induction hard-facing tests are reported in Table 2.

Table 2

| Item No. 1 | Name of parameters 2 | Hard-facing: by melting a continuous layer of charge and cooling until solidified completely without forming of the melt (prior art) 3 | according to the proposed method: peaks 4 | according to the proposed method: valleys 5 |
|---|---|---|---|---|
| 1. | Thickness of alloy layer, mm | 1.4 to 1.6 | 2.7 to 3.0 | 0.01 to 0.15 |
| 2. | Magnitudes and zone area ratio percentage: | | | |
| | zone of incomplete solution | 0.91 to 1.0 mm, 63% | 2.0 to 2.2 mm, 74% | 0.01 to 0.15 |
| | zone of complete solution | 0.5 to 0.6 mm, 37% | 0.7 to 0.78 mm, 26% | |
| 3. | Thickness of layer, mm | 1.55 | 2.8 | 0.1 |
| 4. | Microhardness of zones, kg/mm$^2$: | | | |
| | zone of incomplete solution in a point by the zone boundary | 700 to 1050 | 700 to 1100 | 700 to 800 |
| | in a point in the middle of the zone | 600 to 1000 | 600 to 1000 | |
| | zone of complete solution near the surface | 650 to 850 | 650 to 860 | — |
| 5. | Wear in wear testing machine: | | | |
| | absolute, mm | 1.5 | 1.74 | |
| | wear of layer, % | 97 | 62 | |
| 6. | Relative wear resistance of zones (referred to that of sormite) | | | |
| | zone of incomplete solution (0.4 mm from grain boundary) | 7 | 7 | |
| | in the middle of the layer | 5 | | |

Table 2-continued

| Item No. 1 | Name of parameters 2 | Hard-facing: by melting a continuous layer of charge and cooling until solidified completely without forming of the melt (prior art) 3 | Hard-facing: according to the proposed method: peaks 4 | Hard-facing: according to the proposed method: valleys 5 |
|---|---|---|---|---|
| | zone of complete solution | 3 | | |
| 7. | Relative wear resistance of layer | $0.4 \cdot 7 + 0.55 \cdot 5 + 0.5 \cdot 3 = 7.15$ | $0.4 \cdot 7 + 1.7 \cdot 5 + 0.74 \cdot 3 = 13.52$ | |
| 8. | Relative durability of layer | 1 | $\frac{13.52}{7.15} = 1.74$ | |
| 9. | Wear on test bench in terms of layer thickness: | | | |
| | absolute, mm | 1.45 | 1.73 | 0.069 |
| | layer wear, % | $\frac{1.45}{1.55} \cdot 100 = 93.5$ | $\frac{1.73}{2.8} \cdot 100 = 62.0$ | 69.0 |
| 10. | Relative durability of surface | 1 | $\frac{93.5}{62.0} = 1.5$ | |
| 11. | Cracking when a hard-faced part is bent to R = 15 mm with peaks and valleys spaced: | | | |
| | 10 mm apart | cracks* | cracks** | no cracks |
| | 5 mm apart | cracks* | no cracks | no cracks |

*The sum total width of cracks along the external surface of the alloy is equal to the elongation of the surface in bending.
**Cracks at peak tips extend to the base metal and have a total width equal to 30 to 40% of the elongation of the external surface of the alloy in bending.

The introduction of the proposed method for induction hard-facing ensures as compared to prior art, the advantages below:

a lesser wear and an increase in the relative wear resistance of the hard-faced surface;

a greater durability of parts;

a possibility for bending hard-faced surfaces of parts with no cracking of the hard-faced alloy, this substantially increasing the wear resistance and the durability of hard-faced surfaces of parts and expanding the field of application of induction hard-facing.

As is readily apparent from Tables 1 and 2, a greater wear resistance of the metal of the peaks, due to a preferable extension of the hypereutectic zone of incomplete solution and an increase in layer thickness, substantially raises the wear resistance and the durability of parts; a variation of the wear resistance and of the properties along the length of the hard-faced surface makes it possible to hard-face curved surfaces.

What is claimed is:

1. A method for induction hard-facing, comprising applying a powder charge on the surface of an item, heating said item in the electromagnetic field of an inductor until the powder charge is converted to a melt composed of a hard alloy and a slag, said molten hard alloy being acted upon through the slag layer by a tool the surface thereof facing the melt being provided with peaks and valleys to form the item with peaks comprising hard structural constituents of the melt and with valleys comprising plastic constituents of the melt, the item then being cooled and the action of the tool continued until the hard alloy solidifies completely.

2. A method as claimed in claim 1, wherein the molten hard alloy is acted upon at a melt temperature ranging from 1100° to 1450° C.

* * * * *